US005704224A

United States Patent [19]

Choi

[11] Patent Number: 5,704,224

[45] Date of Patent: Jan. 6, 1998

[54] COOLING AIR CIRCULATING STRUCTURE FOR REFRIGERATOR

[75] Inventor: Jeong Myung Choi, Changwon, Rep. of Korea

[73] Assignee: LG Electronics Inc., Rep. of Korea

[21] Appl. No.: 720,097

[22] Filed: Sep. 27, 1996

[30] Foreign Application Priority Data

Oct. 13, 1995 [KR] Rep. of Korea ..... 35385/1995

[51] Int. Cl.[6] ..... F25D 17/04

[52] U.S. Cl. ..... 62/407; 62/413; 62/417; 62/441

[58] Field of Search ..... 62/404, 407, 405, 62/408, 413, 417, 441

[56] References Cited

U.S. PATENT DOCUMENTS 3,004,401 10/1961 Mann ..... 62/441
3,096,629 7/1963 Rembold ..... 62/407

*Primary Examiner*—John M. Sollecito
*Attorney, Agent, or Firm*—Ostrolenk, Faber, Gerb & Soffen, LLP

[57] ABSTRACT

An improved cooling air circulating structure for a refrigerator which is capable of enabling a smooth flowing of a cooled air by providing a vertically arranged duct unit in a refrigerating compartment thereof and integrally forming a cooled air returning path with the duct unit, which includes a shroud disposed between the evaporator chamber and the grill panel for distributing cooling air generated in the evaporating chamber into the freezing compartment and the refrigerating compartment, respectively, and a duct unit disposed in the refrigerating compartment, comprising an upper freshening section duct portion disposed at an upper rear portion of the refrigerating compartment for providing cooling air into a freshening section of the refrigerating compartment and for returning an air circulated in the upper freshening section portion to the evaporator chamber through an air flow path, and a lower refrigerating section duct portion of which an upper end is integrally connected with a bottom portion of the upper freshening section duct portion for providing cooling air to a refrigerating section of the refrigerating compartment and for returning air circulated in the refrigerating section to the evaporator chamber through the air flow path.

8 Claims, 10 Drawing Sheets

COOLING AIR CIRCULATING STRUCTURE FOR REFRIGERATOR

BACKGROUND OF THE INVENTION

1. Field of the Invention

The present invention relates to a refrigerator structure, and particularly to an improved cooling air circulating force refrigerator which is capable of enabling a smooth flowing of a cooling air in a refrigerator by providing a vertically arranged duct unit in a refrigerator compartment thereof and integrally forming an air discharging and returning paths within duct unit.

2. Description of the Conventional Art

FIGS. 1 and 2 illustrate the construction of a conventional refrigerator. As shown therein, a main body 1 includes a freezing compartment 3 and a refrigerator compartment 4 which are separated by a barrier 2.

A shroud 5 and a grill panel 6 are disposed at a rear portion inside the freezing compartment 3, and an evaporator chamber 7 is formed behind the shroud 5. A fan 8 driven by a fan motor 9, and an evaporator 10 are disposed in the evaporator chamber 7.

The barrier 2 includes a freezing compartment cooled air returning path 2*a*, through which cooled air circulated in the freezing compartment 3 is returned to the evaporating chamber 7, and a refrigerating compartment cooled air returning path 2*b* through which cooled air circulated in the refrigerating compartment 4 is returned to the evaporator chamber 7. In addition, a refrigeration compartment cooled air outlet 2*c* is formed at a rear portion of the barrier 2 for supplying cooled air generated in the evaporator chamber 7, into the refrigerating compartment 4.

A pair of freezing compartment cooled air outlets 5*a* and 5*b* are formed spaced-apart in the shroud 5 and the grill panel 6 to supply cooled air generated in the evaporator chamber 7 to the freezing compartment 3.

A refrigerator compartment damper 11 communicating with the refrigerating compartment cooled air outlet 2*c* of the barrier 2 is disposed at a rear upper portion inside the refrigerating compartment 4 for supplying the cooled air generated in the evaporator chamber 7 to the refrigerating compartment 4. A refrigerating compartment duct 12 is disposed below the refrigerating compartment damper 11, with the duct 12 being downwardly extended from the damper 11. Cooling air outlets 11*a* and 12*a* are formed spaced-apart in the damper 11 and the duct 12, respectively.

A plurality of racks 13, on which food may be placed, are detachably arranged in the refrigerating compartment 4, and a vegetable container 14 is disposed in a bottom portion of the refrigerating compartment 4.

In the drawings, reference numeral 15 denotes a vegetable container lid, reference numeral 16 denotes a freezing compartment door, and reference numeral 17 denotes a refrigerating compartment door.

The operation of the conventional refrigerator will now be explained with reference to the accompanying drawings.

First, the cooled air generated in the evaporator chamber 7 is supplied to the freezing compartment 3 through the shroud 5 and the grill panel 6 by the blowing fan 8 driven by the fan motor 9. Thereafter, the cooled air circulated in the freezing compartment 3 is returned to the evaporator 10 through the freezing compartment cooled air returning path 2*a* in the barrier 2.

In addition, the cooled air generated by the evaporator chamber 7 is supplied to each section of the refrigerating compartment 4, which is partitioned by the plurality of the racks 13, through the cooled air outlets 11*a* and 12*a* formed in the damper 11 and the duct 12. The cooled air discharged into the refrigerating compartment 4 refrigerates food, vegetables and the like placed on each rack 13 or in the vegetable container 14, and is returned to the evaporator chamber 7 through the refrigerating compartment cooled air returning path 2*b*. Here, a deodorizing unit (not shown) is disposed at the entrance of the refrigerating compartment cooled air returning path 2*b*, so that various odors contained in the cooled air returning through the cooled air returning path 2*b* are deodorized by a deodorizing material contained in the deodorizing unit.

However, the conventional refrigerator has disadvantages in that since the cooled air generated in the evaporator chamber 7 is not evenly supplied to foods placed on each rack 13 and stored in the vegetable container 15, the foods can not be effectively refrigerated by the cooled air.

Namely, since the refrigerating compartment duct 12 is vertically and elongatedly formed at the rear portion inside the refrigerating compartment 4, and the cooled air is discharged through the cooled air outlets 11*a* and 12*a* of the duct 12, if foods to be refrigerated are placed toward the front of the refrigerating compartment 4, the returning circulation of the cooled air may be blocked by the foods placed thereat. In addition, if the foods are placed in front of the cooled air outlets 11*a* and 12*a* of the duct 12, the foods may be overcooled.

In addition, the foods placed at the front inside the refrigerating compartment 4 may not be fully refrigerated due to the opening/closing operation of the refrigerating chamber door 17.

As shown in FIG. 2, since the cooled air outlet 2*c*, through which the cooled air generated in the evaporator chamber 7 is supplied to the refrigerating compartment 4, is formed at the rear end portion of the barrier 2 or at the rear right or left corner of the barrier 2, the cooled air must be moved toward the refrigerating compartment damper 11 disposed at the rear portion of the refrigerating compartment 4. At this time, a resistance occurs in the cooled air flowing path, thus preventing the cooled air from smoothly flowing in a described direction. As described above, the horizontal movement of the cooled air in the duct 12 causes a flow resistance with respect to the cooled air, thus slowing-down the flowing speed of the cooled air in the system.

Moreover, the cooled air discharged to each section of the refrigerating compartment 4 and circulated in the refrigerating compartment 4 is returned only through the cooled air returning path 2*b* formed within the barrier 2, with the entrance thereof being formed in a front upper corner inside the refrigerating compartment 4, thus retarding the flow of the cooled air in the system, and thus the refrigerating efficiency is significantly degraded.

In addition, since odors contained in the cooled air being returned to the evaporator chamber 7 are deodorized by the deodorizing unit (not shown) disposed at the entrance of the cooled air returning path 2*b*, the odors may not be effectively deodorized.

In order to overcome the limitations of the above-described conventional refrigerator structure, there has been proposed another conventional art in Japanese Utility Model Publication No. 47-28936 as shown in FIGS. 3 and 4.

As shown therein, this conventional refrigerator structure includes a main body 51, an inner frame 52, and an outer frame 53, an insulation material 54 disposed therebetween, a refrigerating compartment 55, a front door 50, an evaporator chamber 57, a support plate 58, an evaporator 59, a blowing port 60, a fan motor 61, and a fan 62.

A cooled air outlet 65 communicates with the evaporator chamber 57. A guide duct 64 as shown in FIG. 4 is vertically arranged at a rear portion inside the refrigerating compartment 55. A plurality of insertion ports 66 are formed spaced-apart vertically in the guide duct 64. One end of a cooled air discharging duct 71 is selectively inserted into each of the insertion ports 66. Here, three cooled air discharging ducts 71 are inserted into the corresponding insertion port 66. A rack 73 is placed on each of the cooled air discharging ducts 71, with the sides of the rack 73 being attached to the inner sides of the refrigerating chamber 55. An insertion door 67 is hinged to each of the insertion ports 66. Therefore, when the cooled air discharging duct 71 is inserted into the insertion ports 66, the insertion door 67 is opened in order to receive one end of the cooled air discharging duct 71, so that the cooled air discharging duct 71 communicate with the guide duct 64. A plurality of holes, through which cooled air is discharged, are formed at both sides of the cooled air discharging ducts 71.

However, since such conventional refrigerator includes the ducts in which the cooled air flows horizontally and downwardly, it is impossible to evenly distribute the cooled air into the refrigerating compartment, and since the cooled air is not evenly distributed, the foods in the refrigerating chamber may be easily spoiled. In addition, the foods therein may become spoiled due to repeated opening/closing operation of the front door.

Therefore, it is impossible to achieve a desired cooling efficiency of the refrigerator due to the above-described problems. In addition, it is not possible to effectively remove odors from the cooled air being returned to the evaporator chamber.

SUMMARY OF THE INVENTION

Accordingly, it is an object of the present invention to provide an improved cooling air circulating structure for a refrigerator which overcomes the problems encountered in the conventional refrigerator structure.

It is another object of the present invention to provide an improved cooling air circulating structure for a refrigerator which is capable of enabling a smooth flowing of a cooled air by providing a vertically arranged duct unit in a refrigerating compartment thereof and integrally forming a cooled air returning path with the duct unit.

It is another object of the present invention to provide an improved cooling air circulating structure for a refrigerator which is capable of evenly supplying cooled air into a refrigerating compartment, for thus preventing decaying of food in the refrigerating compartment.

It is another object of the present invention to provide an improved cooling air circulating structure for a refrigerator which is capable of more effectively deodorizing odors contained in cooled air returned to an evaporator chamber from the refrigerating compartment.

To achieve the above objects, there is provided a refrigerator structure which includes a shroud disposed between the evaporator chamber and the grill panel for distributing cooling air generated in the evaporating chamber into the freezing compartment and the refrigerating compartment, respectively, and a duct unit disposed in the refrigerating compartment, comprising an upper freshening section duct portion disposed at an upper rear portion of the refrigerating compartment for providing cooling air into a freshening section of the refrigerating compartment and for returning an air circulated in the upper freshening section portion to the evaporator chamber through an air flow path, and a lower refrigerating section duct portion of which an upper end is integrally connected with a bottom portion of the upper freshening section duct portion for providing cooling air to a refrigerating section of the refrigerating compartment and for returning air circulated in the refrigerating section to the evaporator chamber through the air flow path.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
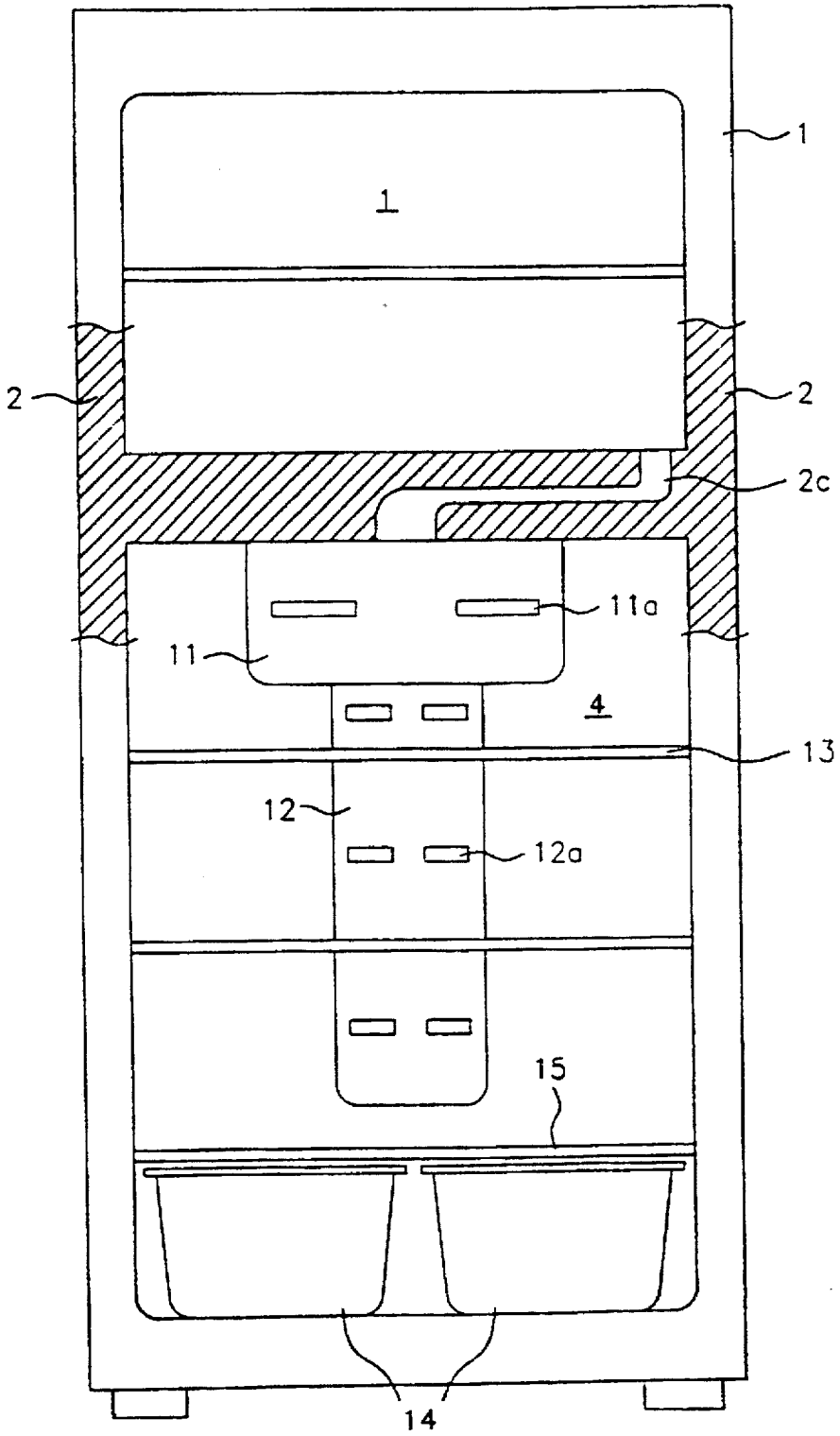
FIG. 1 CONVENTIONAL ART
FIG. 1 is a front view illustrating the structure of a conventional refrigerator for explaining the circulation of cooled air in the system.
Figure 2:
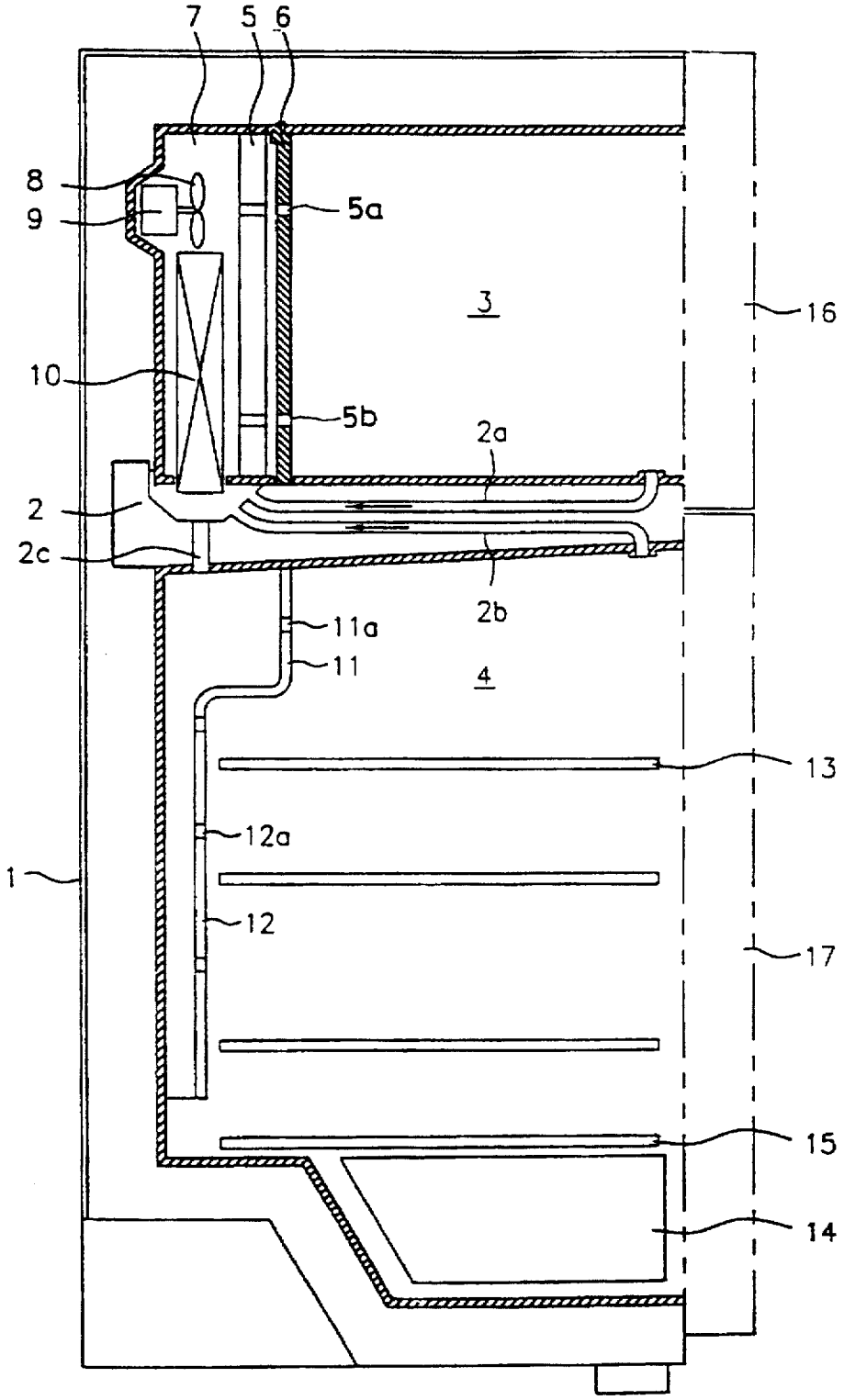
FIG. 2 CONVENTIONAL ART
FIG. 2 is a cross-sectional side view of the conventional refrigerator structure of FIG. 1.
Figure 3:
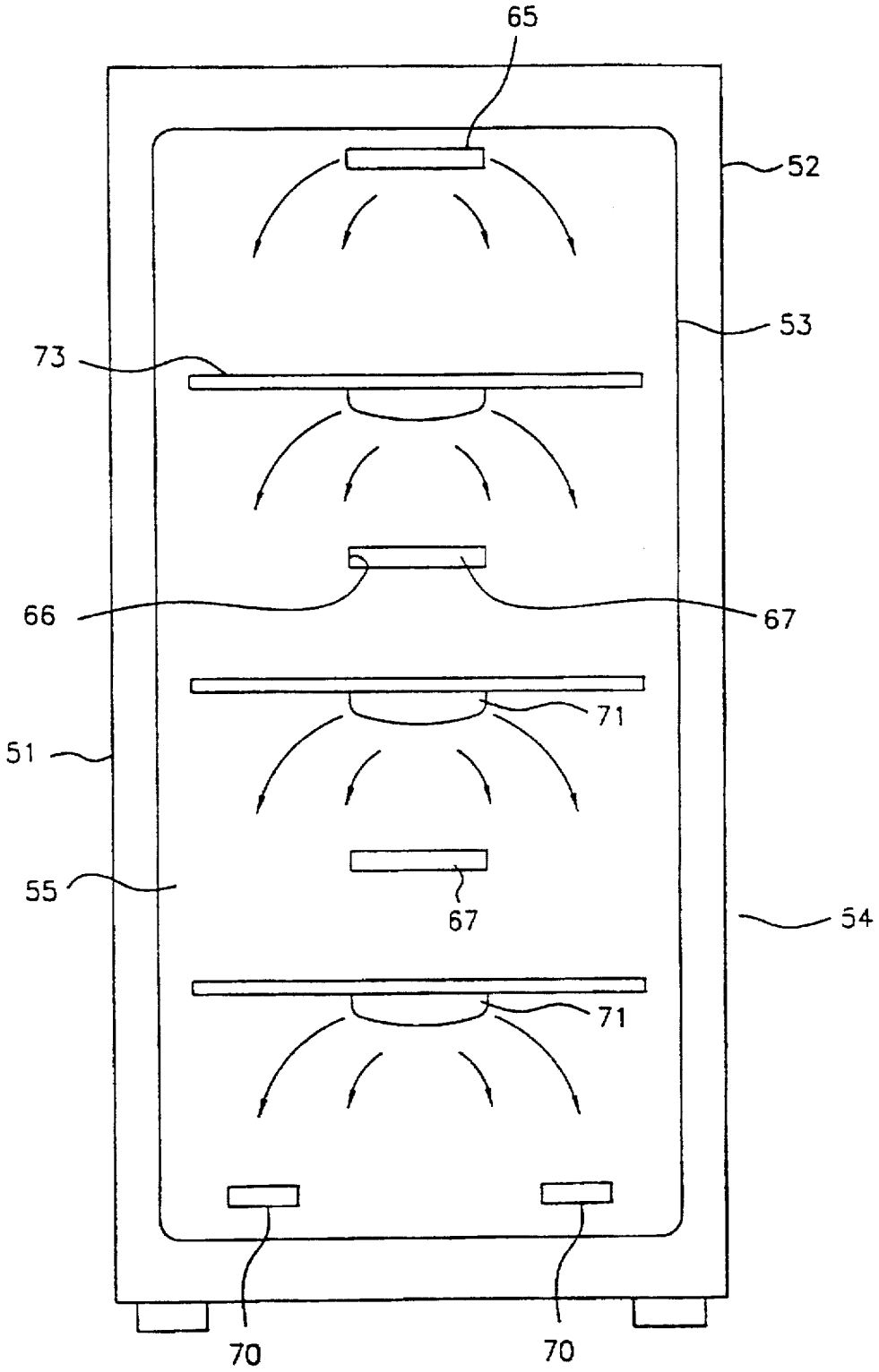
FIG. 3 CONVENTIONAL ART
FIG. 3 is a front view illustrating the structure of a conventional refrigerator as disclosed in Japanese Utility Model Publication Serial No. Sho 47-28936 for explaining the circulation of cooled air in the system.
Figure 4:
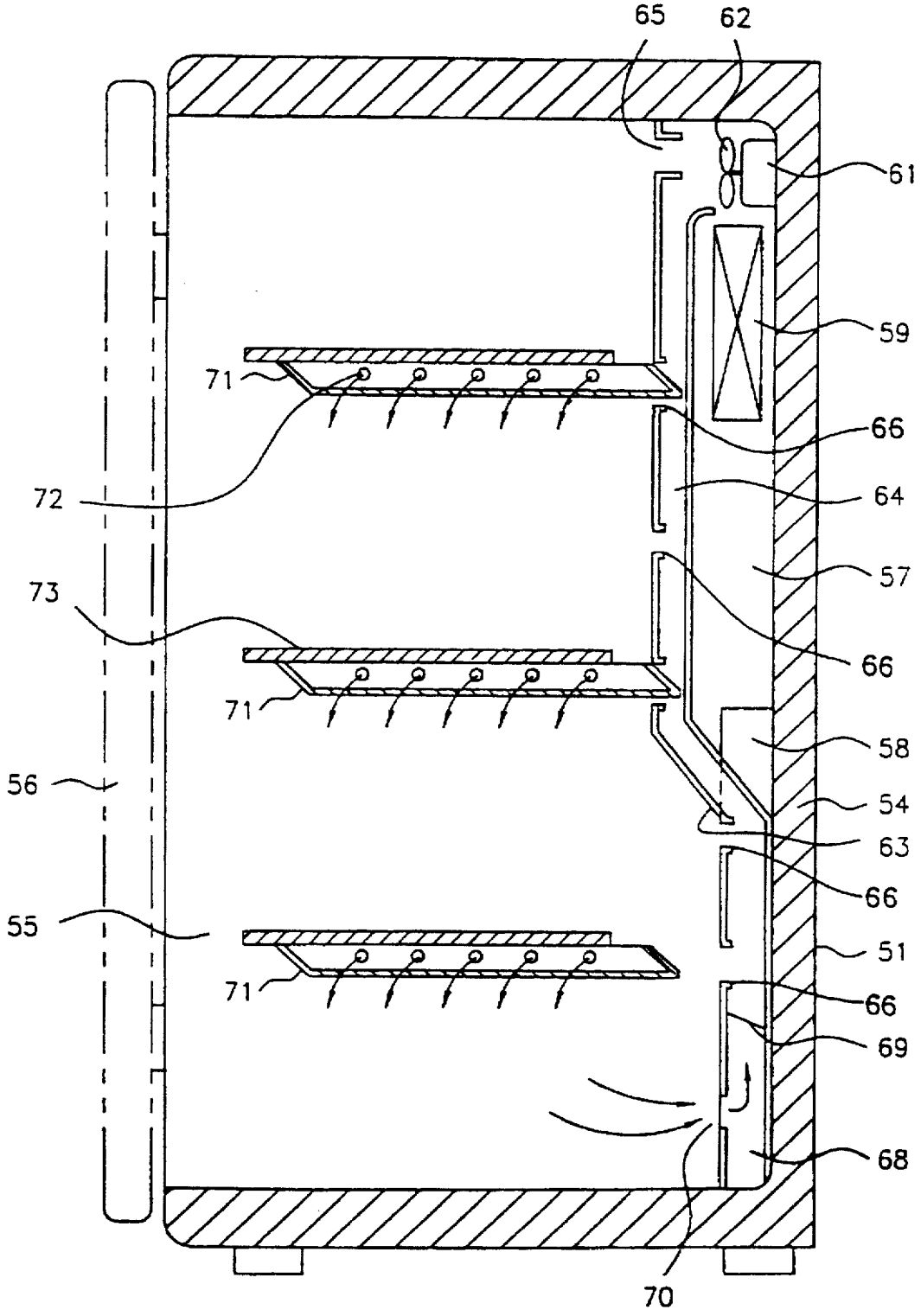
FIG. 4 CONVENTIONAL ART
FIG. 4 is a cross-sectional side view of the conventional refrigerator structure of FIG. 3.
Figure 5:
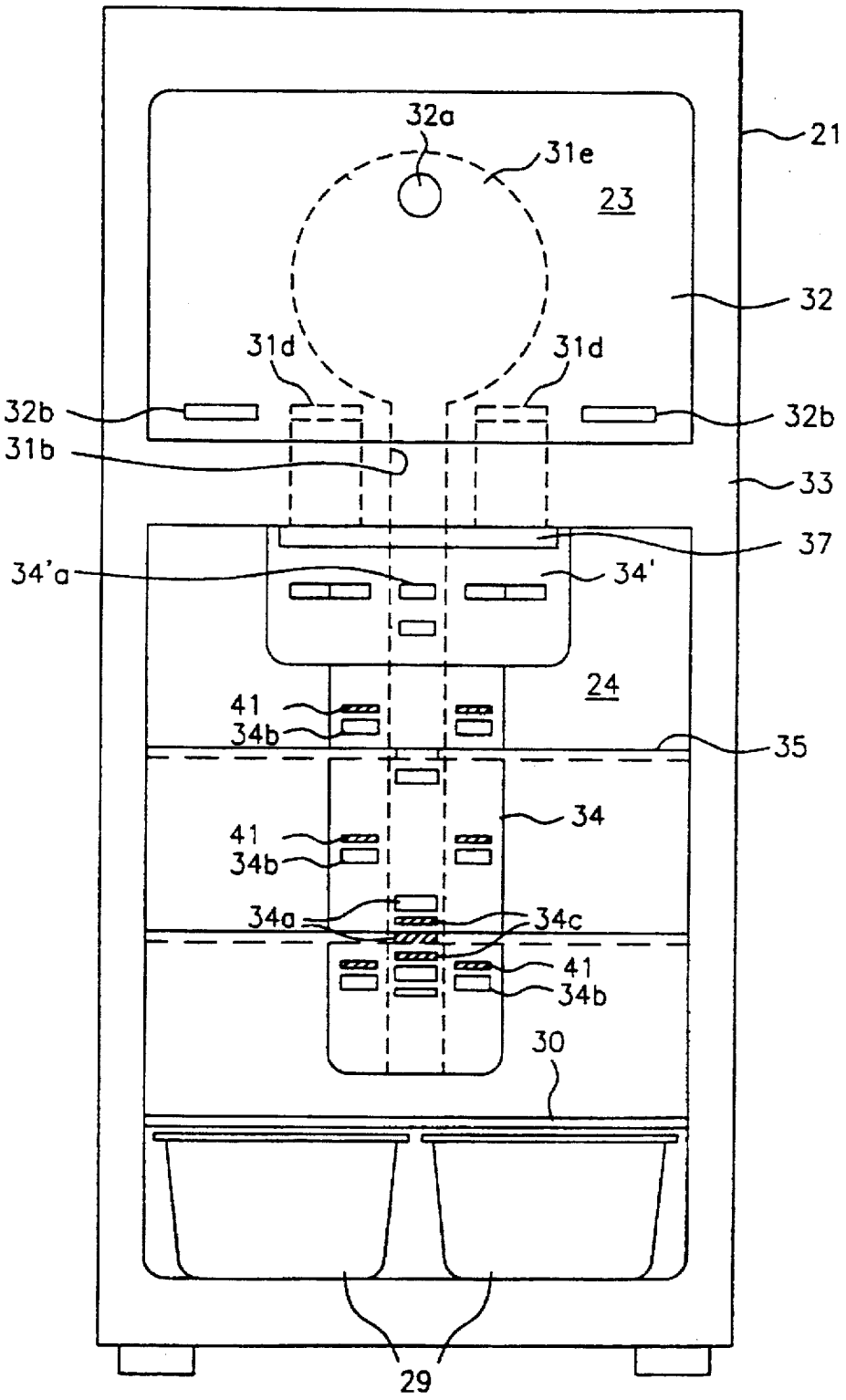
FIG. 5 is a front view illustrating a refrigerator adapting a cooling air circulating structure according to the present invention, for explaining the circulation of cooled air therein.

FIGS. 5 through 8 illustrate the construction of a refrigerator adopting a cooling air circulating structure according to the present invention. In the drawings, reference numeral 21 denotes a main body of the refrigerator, 22 denotes a freezing compartment door, 22' denotes a refrigerating compartment door, 23 denotes a freezing compartment, 24 denotes a refrigerating compartment, 25 denotes an evaporator chamber, 26 denotes a blowing fan, 27 denotes a fan motor, 28 denotes an evaporator, 29 denotes a vegetable container, and 30 denotes a vegetable container lid.

As shown therein, a rectangular shroud 31 is disposed at a rear portion of the freezing compartment 23. In a center portion of the shroud 31, a cooled air discharge hole 31*a* is formed through which cooling air from the evaporator chamber 25 is discharged into the freezing compartment 23. A refrigerating compartment discharge outlet 31*b* is formed at a center lower edge portion of the shroud 31 and communicates with the cooled air discharge hole 31*a* by a circular recess 31*e* formed in the front side of the shroud 31 around the cooled air discharge hole 31*a*, through which cooling air from the evaporator chamber 25 is discharged into the refrigerating compartment 24. A pair of freezing compartment suction ports 31*c* are formed in lower edge portions of the shroud, through which air circulated in the freezing compartment 23 is returned to the evaporator chamber 25. A pair of refrigerating compartment suction guide ducts 31*d* are formed spaced-apart in the lower inner edge portion of the shroud 31 inwardly of the ducts 31*c*, through which air circulated in the refrigerating compartment 24 is returned to the evaporator chamber 25.

A grill panel 32 having a pair of spaced-apart freezing compartment suction ports 32*a* mating with the inlet ports 31*c* of the shroud 31 is arranged between the freezing compartment 23 and the shroud 31.

A barrier 33 having a first cooling air discharge tube 33*a*, and a second cooling air discharge tube 33*b* communicating with the discharge outlet 31*b* of the shroud 31 and also having a refrigerating compartment section guide mating with the suction guide ducts 31*d* of the shroud 31 is arranged between the freezing compartment 23 and the refrigerating compartment 24.

Figure 9:
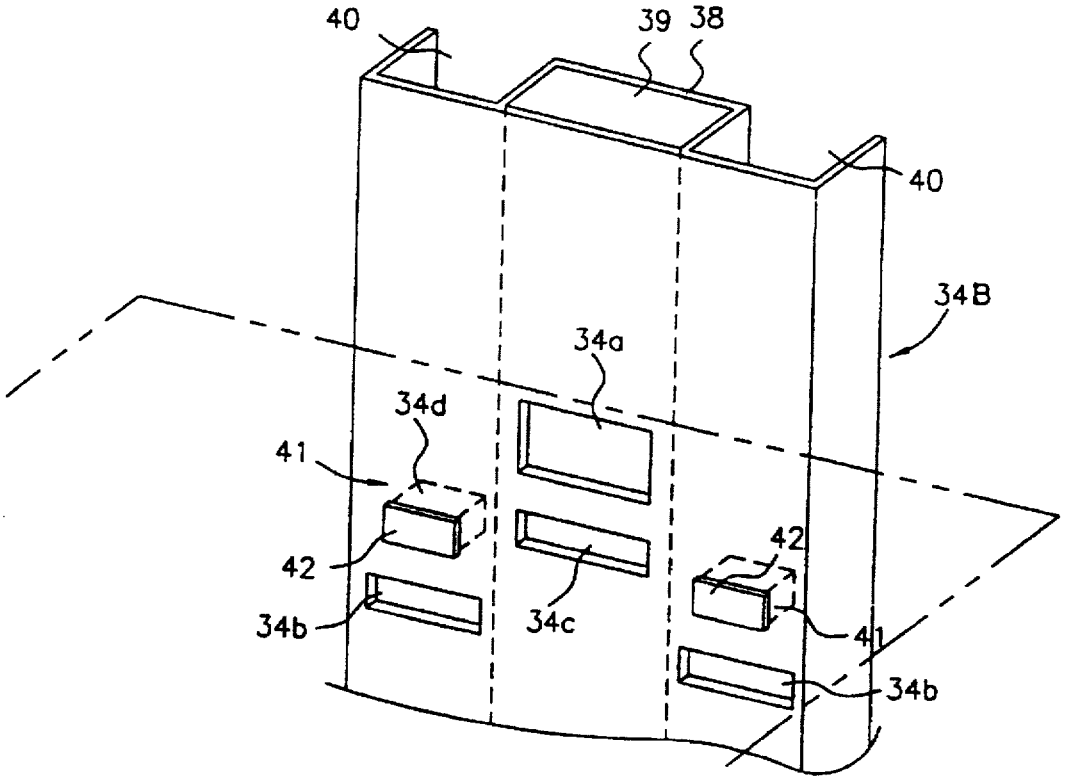
FIG. 9 is a partially cut-away perspective view illustrating the construction of a duct of a refrigerating chamber of a refrigerator according to the present invention.
Figure 10:
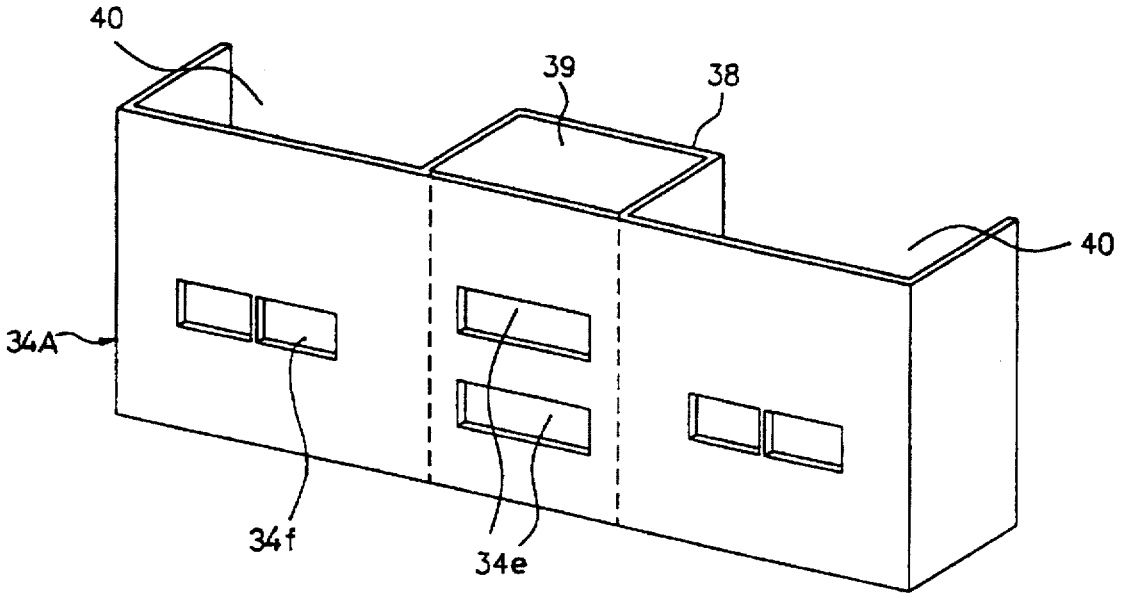
FIG. 10 is a perspective view illustrating a cooling air outlet duct of a freshening chamber of a refrigerator according to the present invention.

As shown in FIGS. 9 and 10, a refrigerating compartment duct unit 34 is provided at a rear portion of the refrigerating compartment 24 and includes an upper freshening section portion 34A, which will be described later, as shown in FIG. 10, and a lower vertically elongated refrigerating section duct portion 34B extended downwardly therefrom, as shown in FIG. 9. The duct unit 34 includes a central discharge duct 39 enclosed by a cooling air separating plate 38, and a pair of spaced-apart refrigerating compartment suction ducts 40.

The first cooling air discharge tube 33*a* in the barrier 33 communicated to the ceiling duct unit 37 having a plurality of cooling air discharge ports 37*a*, whereby a part of the cooling air from the evaporator chamber 25 is discharged through the recess 31*e*, the discharge port 31*b* to and through the discharge port 32*a*, the upper side of the refrigerating compartment 24 through the ceiling duct unit 37.

The discharge duct 39 includes a plurality of cooling air discharge ports 34*a* formed therealong, and a plurality of auxiliary cooling air discharge ports 34*c* each formed below a corresponding one of the cooling air discharge ports 34*a*. Each refrigerating compartment suction duct 40 in the refrigerating section duct portion 34B includes a detachable deodorizing unit 41 insertable in a receiving hole 34*d* formed in a lower portion thereof and including a receptacle 42 and a lower duct port 34*b* formed below each receiving hole 34*d*.

As shown in FIG. 10, the upper freshening section duct portion 34A is attached to the bottom portion of the barrier 33 in the refrigerating compartment 24, and includes the discharge duct 39 having the pair of spaced-apart refrigerating chamber suction ducts 40. Here, the discharge duct 39 includes a pair of spaced-apart cooling air discharge ports 34*e*, and each of the suction ducts 40 includes a pair of spaced-apart freshening section discharge suction ports 34*f*.

Figure 11:
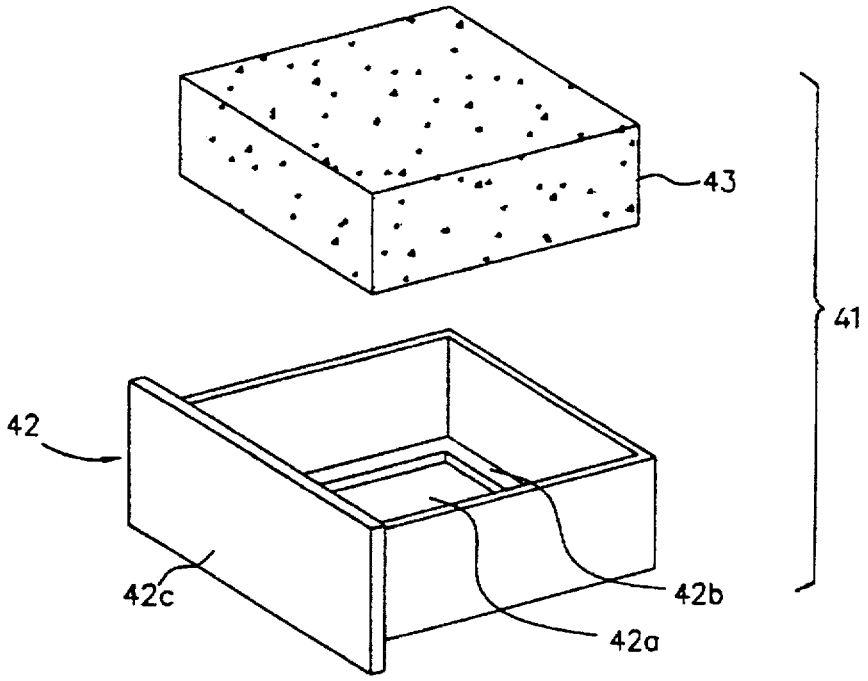
FIG. 11 is a perspective view illustrating a detachable deodorizing member of a refrigerator according to the present invention.

As shown in FIG. 11, the detachable deodorizing unit 41 includes the rectangular receptacle 42 having a front surface, and an open bottom 42*a* and a deodorizing material support section 42*b*, and a deodorizing material 43 is inserted into the receptacle 42.

The discharge duct 39 of the duct unit 34 communicate with the cooling air discharge tube 33*b* in the barrier, and the suction ducts 40 of the duct unit 34 communicate with the suction guide ducts 33*c*, respectively, in the barrier 33.

Figure 12A:
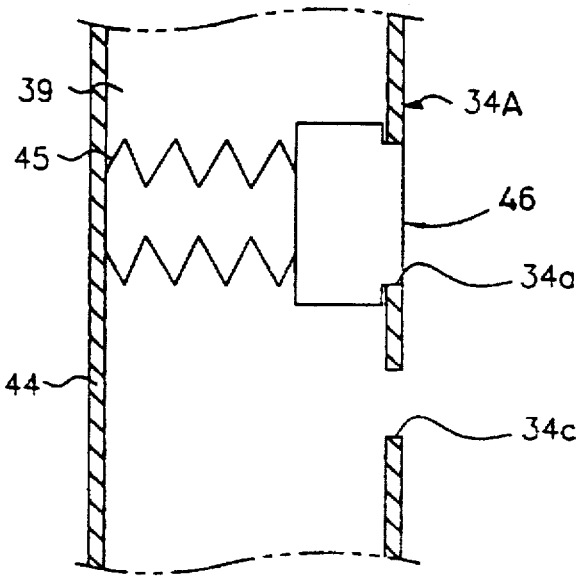
FIG. 12A is a partially cut-away cross-sectional view illustrating an opening/closing member of a horizontal type cooling air outlet of a refrigerator according to the present invention.
Figure 12B:
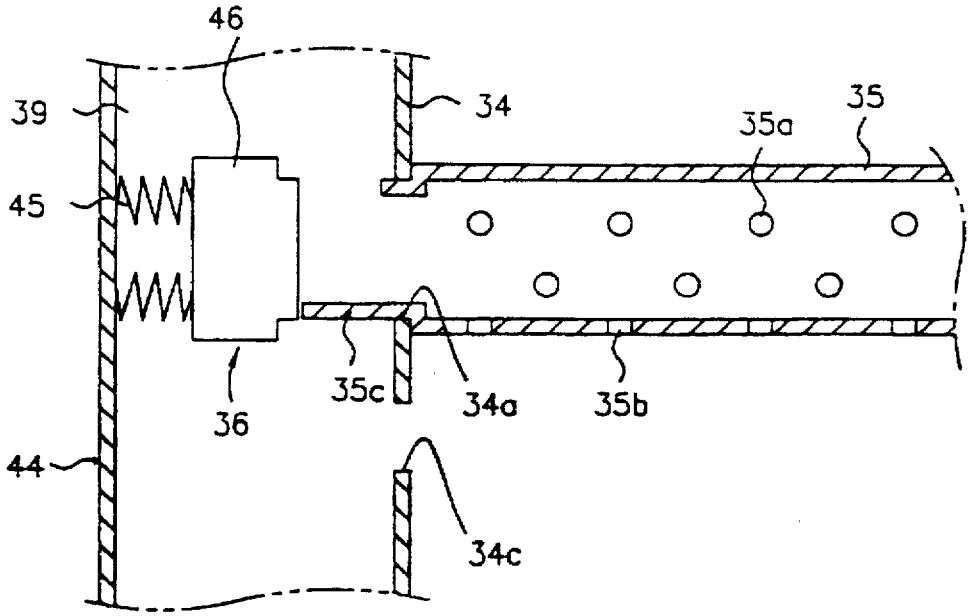
FIG. 12B is a partially cut-away cross-sectional view illustrating the opening/closing member shown in FIG. 12A and a rack duct unit engaged to a main frame of a refrigerator.

As shown in FIGS. 12A and 12B, the refrigerating section duct portion 34B includes the cooling air discharge ports 34*a* through which the cooling air is discharged each of which is opened or closed by a horizontally movable discharge port opening/closing member 46 which at its front surface opens and closes the cooling air discharge ports 34*a*, with an elastic member 45 being connected between the rear of the horizontally movable discharge port opening/closing member 46 and an inner rear wall 44 of the discharge duct 39 of the refrigerating section duct portion 34B.

As shown in FIG. 12B, the rack duct units 35 have a plurality of cooling air discharge holes 35*a* formed in both sides thereof and a plurality of cooling air discharge holes 35*b* formed in the bottom portion thereof and can be detachably inserted into the cooling air discharge port 34*a* by inwardly opening the horizontally movable discharge port opening/closing member 46 by means of an end protrusion of the rack duct unit 35.

The operation of the cooling air circulation structure for a refrigerator according to the present invention will now be explained with reference to the accompanying drawings.

A part of the cooling air generated in the evaporator chamber 25 is discharged to the freezing compartment 23 through the shroud 31 via the cooled air discharge hole 31*a* and the discharge port 32*a* in the grill panel 32 under the blowing force of the fan 26 driven by the fan motor 27, for thus freezing the foods in the freezing compartment 23. In addition, the cooling air circulated in the freezing compartment 23 is returned to the evaporator chamber 25, in which the evaporator 28 is installed, through the suction ports 32*b* and 31*c* respectively formed at the lower edge portions of the shroud 31 and the grill panel 32.

Meanwhile, a part of the cooling air from the cooled air discharge hole 31*a* of the shroud 31 flows between the rear surface of the grill panel 32 and the recess 31*e* formed in the shroud 31. The thusly flowing cooled air is introduced into the refrigerating compartment 24 through the first and second cooling air discharge ports 33*a* and 33*b* formed within the barrier 33.

The cooling air discharged to the first cooled air discharge port 33*a* of the barrier 33 flows into the refrigerating compartment 24 through the cooling air discharging port 37*a* of the ceiling duct unit 37 disposed on the inner ceiling portion inside the refrigerating chamber 24, for thus enhancing the cooling efficiency of the refrigerator by flowing the cooling air from the upper side to the lower side inside the refrigerating compartment 24.

The cooling air discharged to the second cooling air discharge port 33*b* of the barrier 33 moves downwardly along the freshening section duct portion 34A through the discharge duct 39 to the refrigerating section duct portion 34B.

In the refrigerating compartment 24, the rack duct units 35 may be arranged so as to partition the interior of the refrigerating compartment 24 into several sections. Where a rack duct unit 35 is not inserted into a cooling air discharge port 34*a*, the horizontally movable opening/closing member 46 maintains its closed state. Namely, the cooling air discharge ports 34*a* formed in the discharge duct 39 of the refrigerating section duct portion 34*b* are closed due to the urging force of the elastic members 45.

Since an auxiliary cooling air discharge ports 34*c* is formed below each cooling air discharge ports 34*a* of the discharge duct 39, when the cooling air discharge port 34*a* of the refrigerating chamber discharge duct 39 is closed by the horizontally movable opening/closing member 46, a minimum amount of the cooling air is supplied to the refrigerating compartment 24 section in which the cooling air discharge port 34*a* is closed, through the auxiliary cooling air discharge port 34*c* which is always opened.

In addition, when a rack duct unit 35 is engaged at each section of the refrigerating compartment 24, since the inner end 35*c* of the rack duct unit 35 inwardly pushes the horizontally movable opening/closing member 46 which is elastically supported by the elastic member 45, the cooling air discharge port 34*a* of the discharge duct 39 is opened, and the cooling air moving downwardly along the discharge duct 39 of the refrigerating section duct portion 34B moves along the cooling air flow path formed within the rack duct unit 35. Thereafter, the cooling air is evenly discharged into each section of the refrigerating compartment 24 through the cooling air discharge holes 35*a* and 35*b*.

Figure 6:
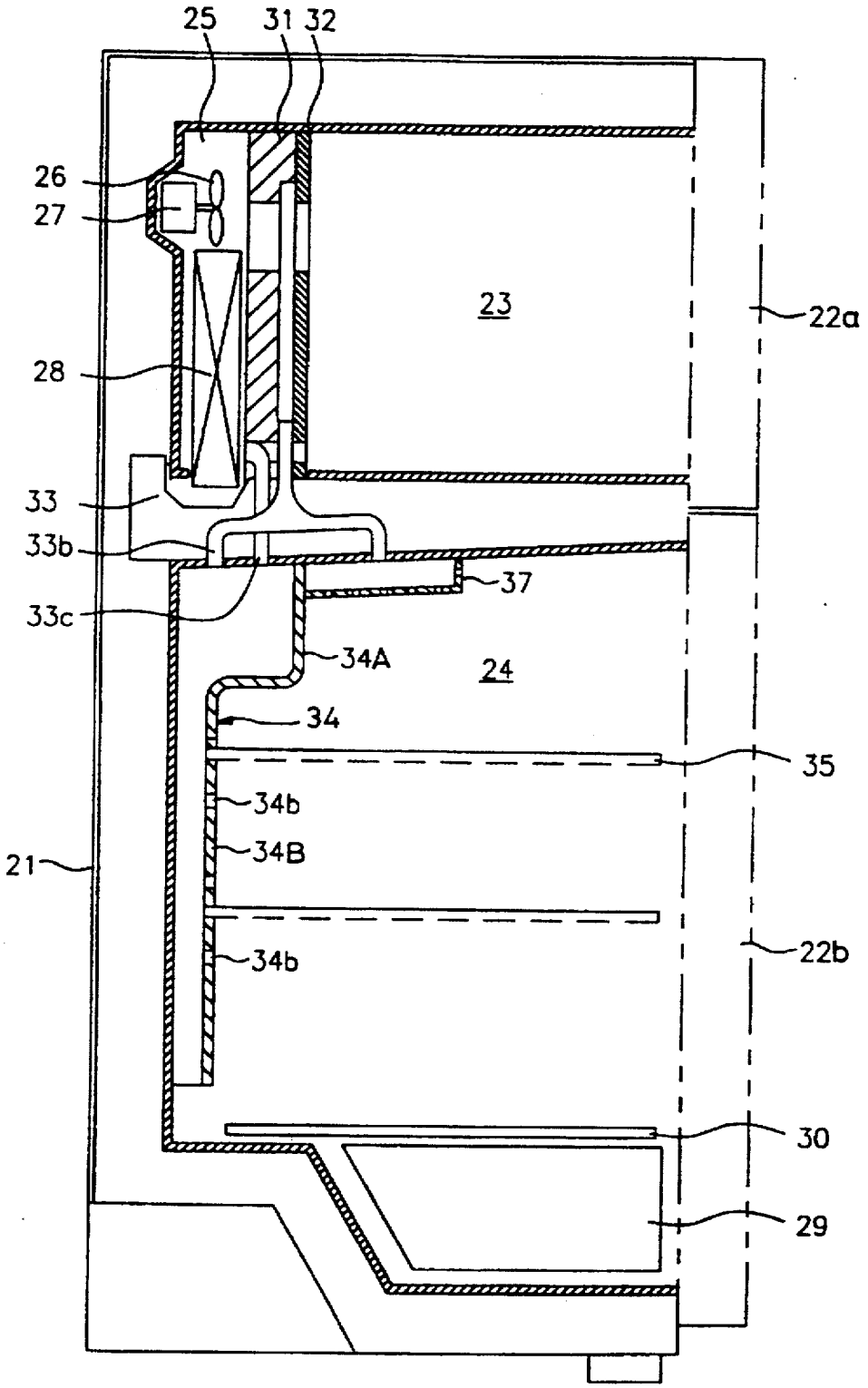
FIG. 6 is a cross-sectional side view of the refrigerator structure shown in FIG. 5.
Figure 7:
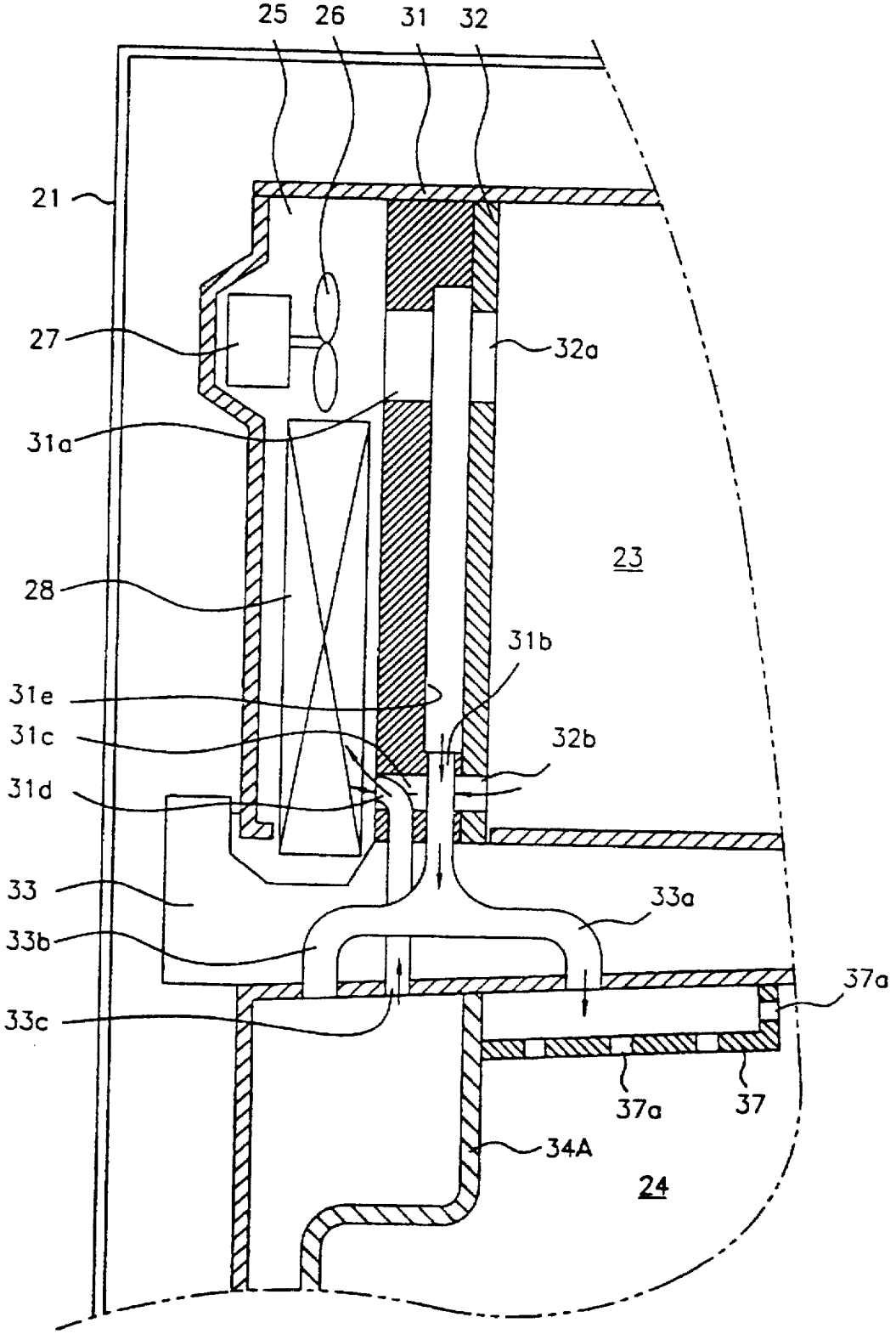
FIG. 7 is a partial cross-sectional side view illustrating the cooled air circulation path of FIG. 6 for explaining the cooling air circulation structure of a refrigerator according to the present invention.
Figure 8:
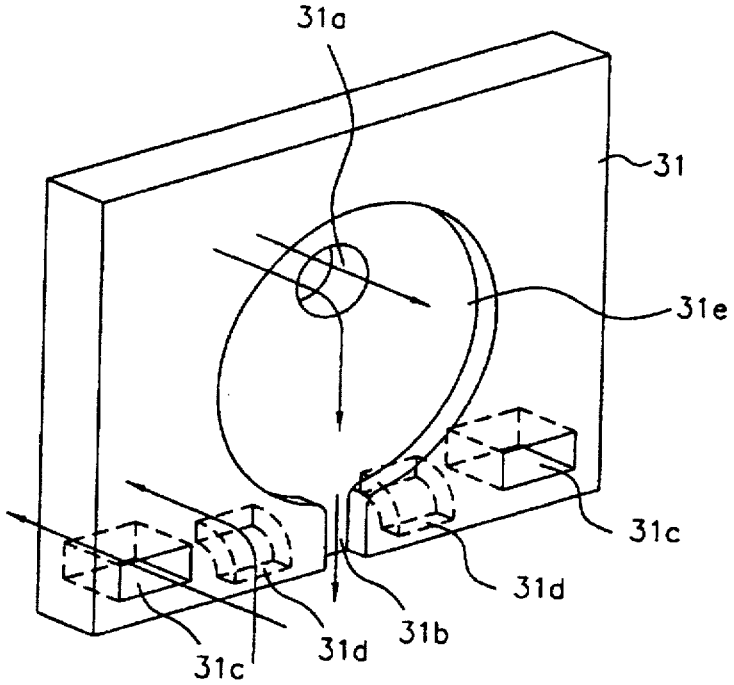
FIG. 8 is a perspective view illustrating a shroud of a refrigerator according to the present invention.

The cooling air which is discharged laterally and downwardly from the cooling air discharge holes 35*a* and 35*b*, as shown in FIG. 6, refrigerates foods in each section. Thereafter, the air is sucked through the lower duct port 34*b* formed in the suction ducts 40 and is upwardly moved along the suction ducts 40. The air is returned to the evaporator chamber 25 through the suction port 33*c* formed within the barrier 33 and the suction guide ducts 31*d* formed at the lower edge portion of the shroud 31.

Furthermore, since a detachable deodorizing unit 41 is disposed above the lower duct port 34*b* formed in each suction duct 40 of the refrigerating section duct unit portion 34*b*, odors contained in the returning air are deodorized by the deodorizing material 43 in the receptacle 42.

Namely, the returning air sucked into the lower duct ports 34*b* of the refrigerating section suction ducts 40 always passes through the detachable deodorizing units 41. In this embodiment of the present invention, a number of deodorizing materials 43 may be disposed therein, for thus more effectively deodorizing the odors contained in the returning air.

As described above, the cooling air circulating structure for a refrigerator according to the present invention is basically directed to independently circulating the cooling air, for thus improving the cooling efficiency of the refrigerator.

In addition, it is possible to prevent an overcooling and spoiling of the foods in the refrigerator by providing a plurality of rack duct units having a plurality of cooling air ports.

Moreover, it is possible to more effectively deodorize food odors by deodorizing the returning air by multiple steps.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A cooling air circulating structure for a refrigerator having a freezing compartment, an evaporator chamber, an evaporator disposed in the evaporator chamber for generating a cooling air, a grill panel disposed at a rear portion of the freezing compartment, a refrigerating compartment, and a barrier disposed between the freezing compartment and the refrigerating compartment, the improvements comprising:

a shroud disposed between the evaporator chamber and the grill panel for distributing cooling air generated in the evaporating chamber into the freezing compartment and the refrigerating compartment, respectively; and a duct unit disposed in the refrigerating compartment, comprising:

an upper freshening section duct portion disposed at an upper rear portion of the refrigerating compartment for providing cooling air into a freshening section of the refrigerating compartment and for returning an air circulated in the upper freshening section portion to the evaporator chamber through an air flow path; and a lower refrigerating section duct portion of which an upper end is integrally connected with a bottom portion of the upper freshening section duct portion for providing cooling air to a refrigerating section of the refrigerating compartment and for returning air circulated in the refrigerating section to the evaporator chamber through the air flow path.

2. The cooling air circulating structure of claim 1, wherein said shroud includes:

a cooling air discharge hole formed in a center portion thereof, through which a cooling air from the evaporator chamber is discharged into the freezing compartment and the refrigerating compartment;

a recess formed around the cooling air discharge hole for guiding the cooling air from the cooling air discharge hole;

a discharge outlet formed at a lower center portion thereof communicating with the recess, through which the cooling air from the circular recess is guided;

a pair of spaced-apart suction ports formed at a lower edge portion thereof, through which air circulated in the freezing compartment is returned to the evaporator chamber;

a pair of spaced-apart suction guide ducts formed at the lower edge portion thereof, through which the air circulated in the refrigerating compartment is returned to the evaporator chamber.

3. The cooling air circulating structure of claim 2 further comprising a ceiling duct unit disposed on an upper portion of the refrigerating compartment and having a plurality of holes and wherein said barrier includes a first cooling air discharge tube connected between the discharge outlet of the shroud and the refrigerating compartment through the ceiling duct unit through which cooling air from the first cooling air discharge tube is discharged into the freshening section of the refrigerating compartment;

a second cooling air discharge tube connected between the discharge outlet of the shroud and the upper freshening section portion of the duct unit; and a pair of suction guide ducts communicating with the evaporator chamber through the suction guide ducts of the shroud.

4. The cooling air circulating structure of claim 3, wherein said upper freshening section portion of the duct unit includes:

a freshening section discharge duct communicating with the second cooling air discharge tube of the barrier and having a pair of spaced-apart cooling air discharge ports through which the cooling air from the second cooling air discharge tube of the barrier is discharged into the freshening section of the refrigerating compartment; and a pair of freshening section suction ducts communicating with the suction guide ducts of the barrier and having a plurality of freshening section suction ports through which the air circulated in the freshening section is returned to the evaporator chamber through the suction guide ducts of the barrier and the suction ports of the shroud.

5. The cooling air circulating structure of claim 4, wherein said refrigerating section duct portion of the duct unit includes:

a refrigerating section discharge duct portion communicating with the freshening section discharge duct portion of the upper freshening section duct portion and having a plurality of cooling air discharge ports through which cooling air is discharged into the refrigerating compartment, the cooling air discharge port being selectively opened/closed, and an auxiliary cooling air discharge port formed below each cooling air discharge port through the cooling air is discharged into the refrigerating compartment; and a pair of refrigerating section suction ducts communicating with the suction guide ducts of the barrier via the freshening section suction ducts and having a detachable deodorizing unit and a lower suction port formed below the detachable deodorizing unit, through which the air circulated in the refrigerating compartment is returned to the evaporator chamber through the suction guide ducts of the shroud.

6. The cooling air circulating structure of claim 1, further comprising a rack duct unit having a plurality of air discharge holes formed in an outer circumferential surface thereof through which cooling air from the cooling discharge port of the refrigerating section duct portion.

7. The cooling air circulating structure of claim 5, wherein said detachable deodorizing unit includes a receptacle having an open bottom and a deodorizing material support section for receiving a deodorizing material therein, the receptacle being disposed in the path of the returning air for deodorizing odors contained in the air returning to the evaporator chamber.

8. The cooling air circulating structure of claim 1, wherein said refrigerating section duct portion includes a discharge port opening/closing member which is elastically supported by an elastic member connected between a rear side thereof and an inner wall of a discharge duct of said refrigerating section duct portion for urging a front side of said member to block the cooling air discharge port and to allow said member to be pressed rearwardly to open said discharge port when one end of a rack duct unit is inserted into the cooling air discharge port.

* * * * *